US005492445A

United States Patent [19]

Shaffer et al.

[11] Patent Number: 5,492,445

[45] Date of Patent: Feb. 20, 1996

[54] HOOK NOZZLE ARRANGEMENT FOR SUPPORTING AIRFOIL VANES

[75] Inventors: James E. Shaffer, Maitland, Fla.; Paul F. Norton, San Diego, Calif.

[73] Assignee: Solar Turbines Incorporated, San Diego, Calif.

[21] Appl. No.: 198,886

[22] Filed: Feb. 18, 1994

[51] Int. Cl.[6] ..... F01D 9/02; F01D 9/04

[52] U.S. Cl. ..... 415/136; 415/139; 415/189; 415/200; 415/209.3

[58] Field of Search ..... 415/136, 138, 415/139, 189, 190, 200, 209.2, 209.3

[56] References Cited

U.S. PATENT DOCUMENTS

| | | | |
|---|---|---|---|
| 1,525,804 | 2/1925 | Doran | 415/136 |
| 2,980,396 | 4/1961 | Movsesian | 415/189 |
| 3,817,655 | 6/1974 | Huesgen et al. | 415/189 |
| 3,841,787 | 10/1974 | Scalzo | 415/136 |
| 4,088,978 | 2/1977 | Smale | 415/200 |
| 4,522,559 | 6/1985 | Burge et al. | 415/138 |
| 4,768,924 | 9/1988 | Carrier et al. | 415/138 |

*Primary Examiner*—Edward K. Look
*Assistant Examiner*—James A. Larson
*Attorney, Agent, or Firm*—Trevor B. Joike

[57] ABSTRACT

A gas turbine engine's nozzle structure includes a nozzle support ring, a plurality of shroud segments, and a plurality of airfoil vanes. The plurality of shroud segments are distributed around the nozzle support ring. Each airfoil vane is connected to a corresponding shroud segment so that the airfoil vanes are also distributed around the nozzle support ring. Each shroud segment has a hook engaging the nozzle support ring so that the shroud segments and corresponding airfoil vanes are supported by the nozzle support ring. The nozzle support ring, the shroud segments, and the airfoil vanes may be ceramic.

28 Claims, 4 Drawing Sheets

HOOK NOZZLE ARRANGEMENT FOR SUPPORTING AIRFOIL VANES

The Government of the United States of America has rights in this invention pursuant to Contract No. DE-AC02-92CE40960 awarded by the U.S. Department of Energy.

TECHNICAL FIELD

This invention relates to nozzle structures for gas turbine engines and, more particularly, to nozzle structures having hooks for supporting airfoil vanes on a nozzle support ring.

BACKGROUND ART

A typical gas turbine engine, such as an axial flow gas turbine engine, includes a compressor section, a turbine section, and a combustor section. This combustor section is located between the compressor section and the turbine section, and produces high temperature gas by burning a mixture of fuel and compressed air. The combustor section is typically annular and has radially inner and outer walls. A nozzle structure, which is typically annular in shape, has an inlet which mates, and is radially coextensive, with the combustor section's inner and outer walls at the outlet side of the combustor section of the gas turbine engine.

A conventional nozzle structure is positioned in its desired location within a gas turbine engine by clamping the nozzle structure between axial adjacent faces of a supporting structure. This conventional nozzle structure normally includes a radially outer shroud, a radially inner shroud, and a plurality of airfoil vanes. Each of the airfoil vanes extends radially between the outer and inner shrouds, and has a first end fixed to the outer shroud and a second end fixed to the inner shroud.

These airfoil vanes of the nozzle structure are arranged to optimally direct the high temperature gas produced by the combustor section toward the blades of a turbine wheel assembly in the gas turbine engine's turbine section. Accordingly, the high temperature gas accelerates through the nozzle structure in order to thermodynamically and aerodynamically engage the blades mounted on the turbine wheel of the turbine section.

Because of efforts to maintain the combustor section's walls below a reasonable temperature, the temperature profile of the high temperature gas exiting the combustor section is normally highest at its midpoint, which is radially intermediate the inner and outer walls of the combustor section. Moreover, the temperature of the gas produced by a combustor section of such a gas turbine engine is constantly being increased to improve the efficiency, and thereby the fuel economy, of the gas turbine engine. Increasing the temperature of the gas produced by a combustor section of a gas turbine engine results in an increased temperature at the inlet side of the gas turbine engine's nozzle structure.

Because of such high outlet temperatures of the gas exiting from the combustor section, and because the temperature profile of the high temperature gas exiting the combustor section directs the hottest portion of this gas onto the airfoil vanes of the nozzle structure, ceramic is being used for the material of nozzle structures, particularly for the airfoil vanes, since ceramic functions very well in high temperature environments. Ceramic nozzle structures are, however, typically mounted on metal supporting structures which commonly constitute the majority of the structural members in a gas turbine engine. Differential thermal expansion between a ceramic nozzle structure and its metal supporting structure results in high, potentially damaging thermal stresses, particularly where the ceramic airfoil vanes are clamped between outer and inner shrouds.

The assignee of the present invention has recently developed a cantilevered ceramic nozzle structure employing a radially outer shroud having airfoil vanes connected at one end thereto, and protruding radially inwardly therefrom. That is, first ends of the airfoil vanes are connected to the outer shroud, and second ends of the airfoil vanes extend radially toward the inner shroud. However, the radially inner shroud is radially spaced apart from the second ends of the airfoil vanes. Therefore, the second ends of the airfoil vanes may be referred to as free ends. Because the second ends of the airfoil vanes are free ends, thermal stress on the airfoil vanes is substantially reduced.

In such a cantilevered ceramic nozzle structure, the outer shroud is supported to a nozzle support ring by pins which extend through pin receiving holes in the outer shroud and corresponding pin receiving holes in the nozzle support ring. In this arrangement, however, great care must be taken to ensure that each of the pin receiving holes of the outer shroud and its corresponding pin receiving hole of the nozzle support ring are nearly perfectly aligned in order to avoid stressing the outer shroud and/or the nozzle support ring. The present invention provides a cantilevered nozzle structure which avoids the use of pins for supporting airfoil vanes to a nozzle support ring.

DISCLOSURE OF THE INVENTION

In accordance with one aspect of the present invention, an annular nozzle arrangement for a gas turbine engine includes an annular nozzle support ring, an annular shroud, and an airfoil vane. The annular shroud has a hook which engages the annular nozzle support ring so that the annular shroud is supported by the annular nozzle support ring. The airfoil vane is connected to the annular shroud.

In accordance with another aspect of the present invention, a nozzle arrangement for a gas turbine engine includes a flow directing means for directing gas flow from a combustor section of a gas turbine engine to a turbine wheel of the gas turbine engine, and a supporting means for supporting the flow directing means. The flow directing means includes a hook engaging the supporting means so that the flow directing means is supported by the supporting means.

In accordance with yet another aspect of the present invention, a nozzle arrangement for a gas turbine engine includes a ceramic nozzle support ring, a plurality of ceramic shroud segments, and a plurality of ceramic airfoil vanes. The plurality of ceramic shroud segments are distributed around the ceramic nozzle support ring. Each of the ceramic shroud segments has a ceramic hook which engages the ceramic nozzle support ring so that each of the ceramic shroud segments is supported by the ceramic nozzle support ring. Each of the ceramic airfoil vanes has first and second ends. The first end of each ceramic airfoil vane is connected to a corresponding ceramic shroud segment so that the ceramic airfoil vanes are distributed around the ceramic nozzle support ring so as to direct gas flow from a combustor section to a turbine wheel of a gas turbine engine. The second end of each ceramic airfoil vane is a free end.

BRIEF DESCRIPTION OF THE DRAWINGS

These and other features and advantages will become more apparent from a detailed consideration of the invention when taken in conjunction with the drawings in which.

BEST MODE FOR CARRYING OUT THE INVENTION

Figure 1:
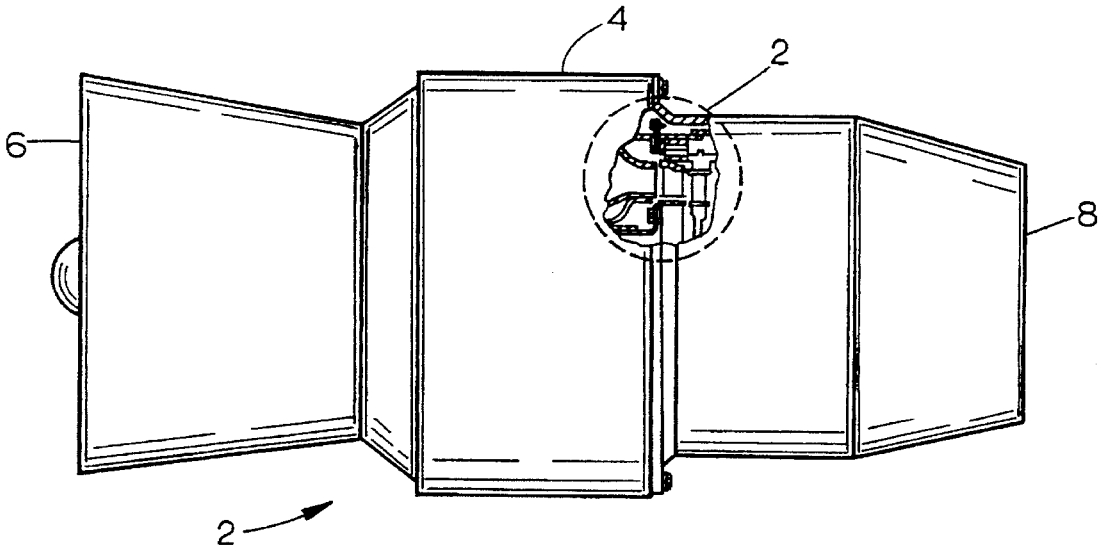
FIG. 1 is a diagrammatic side view of an exemplary gas turbine engine illustrating a partial sectional view of the gas turbine engine's internal structure through a cut-away of the gas turbine engine's casing.

As shown in FIG. 1, an axial flow gas turbine engine 2 has an outer casing 4 and includes inlet and exhaust openings 6 and 8, respectively, for drawing air into, and expelling combustion by-products from, the gas turbine engine 2.

The gas turbine engine 2 is, except for a nozzle structure 10 as illustrated in FIGS. 2–8, of conventional construction and, as is typical, includes a compressor section, a turbine section, and a combustor section. The combustor section is located between the compressor section and the turbine section, and produces high temperature gas by burning a mixture of fuel and compressed air.

Figure 2:
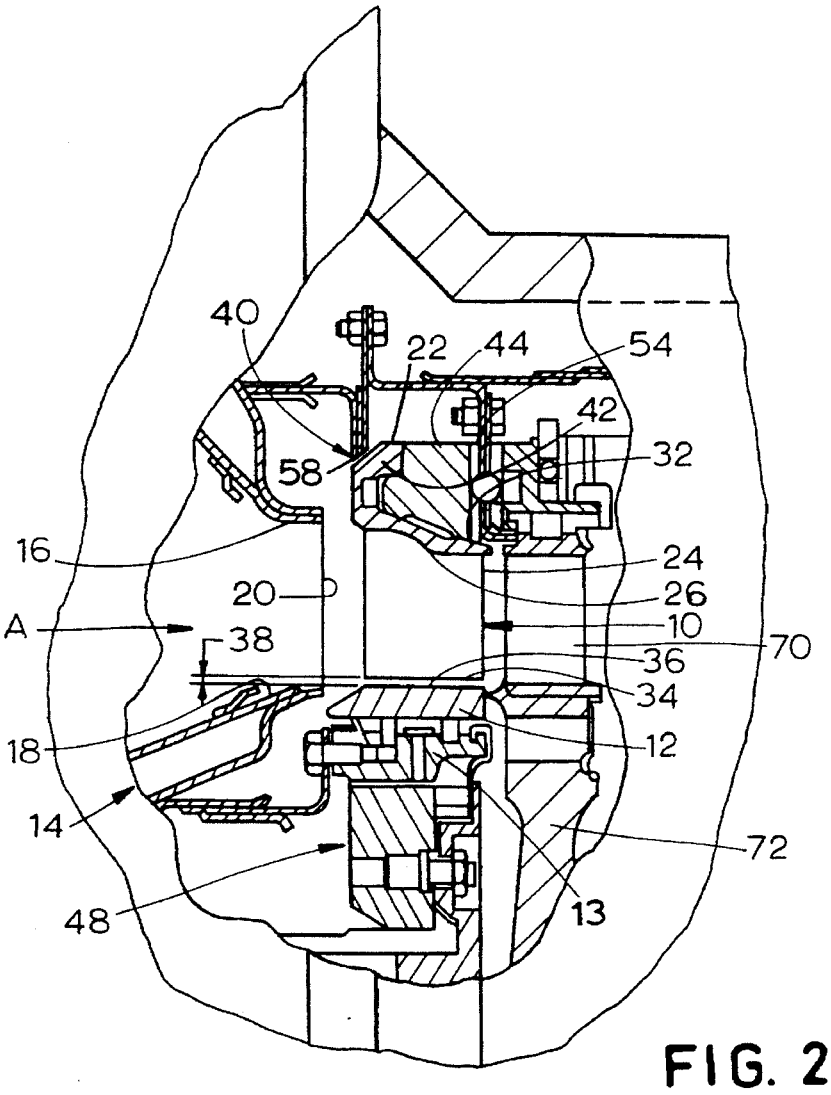
FIG. 2 is an enlarged side view of the nozzle structure shown through the cut-away in FIG. 1.

As shown in FIG. 2, the gas turbine engine 2 includes the nozzle structure 10 and an inner shroud 12 at an outlet side of a combustor 14. As is conventional, the inner shroud 12 is supported by first stage diaphragm members 13. While only a portion of the nozzle structure 10, the inner shroud 12, and the combustor 14 are illustrated in FIG. 2, it is to be understood that the nozzle structure 10, the inner shroud 12, and the combustor 14 may each be annular in shape so that they extend through substantially 360° of arc within the outer casing 4 of the gas turbine engine 2.

The combustor 14 includes an annular outer wall 16 and an annular inner wall 18 which cooperatively define an annular exit port 20 through which the high temperature gas produced by burning a fuel and air mixture exits the combustor 14 in a direction generally indicated by an arrow A.

While the illustrated nozzle structure 10 may be of unitized construction, the nozzle structure 10 is disclosed herein as comprising a plurality of nozzle structure segments each having a circumferential distance of less than 360° but combining to result in a substantially annular 360° nozzle structure.

Figure 3:
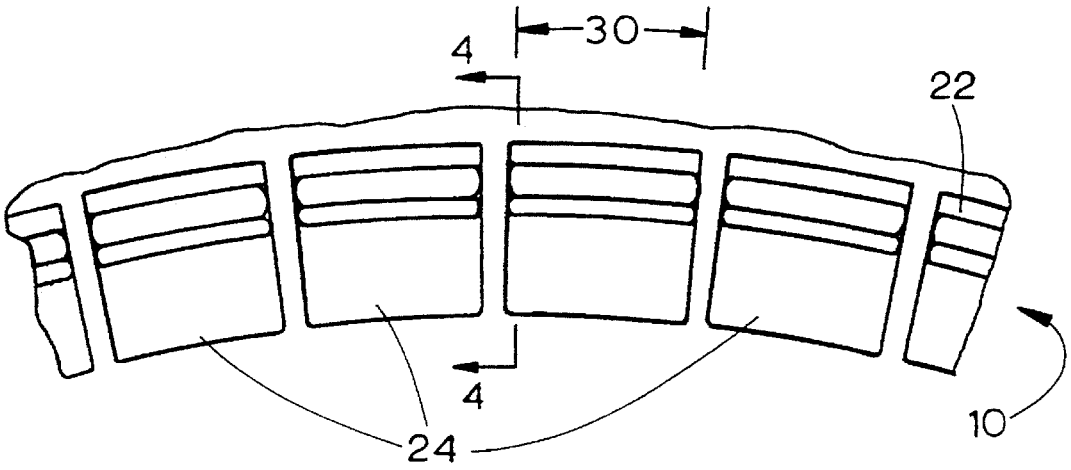
FIG. 3 illustrates an enlarged end view of a section of the nozzle structure shown in FIG. 2.
Figure 4:
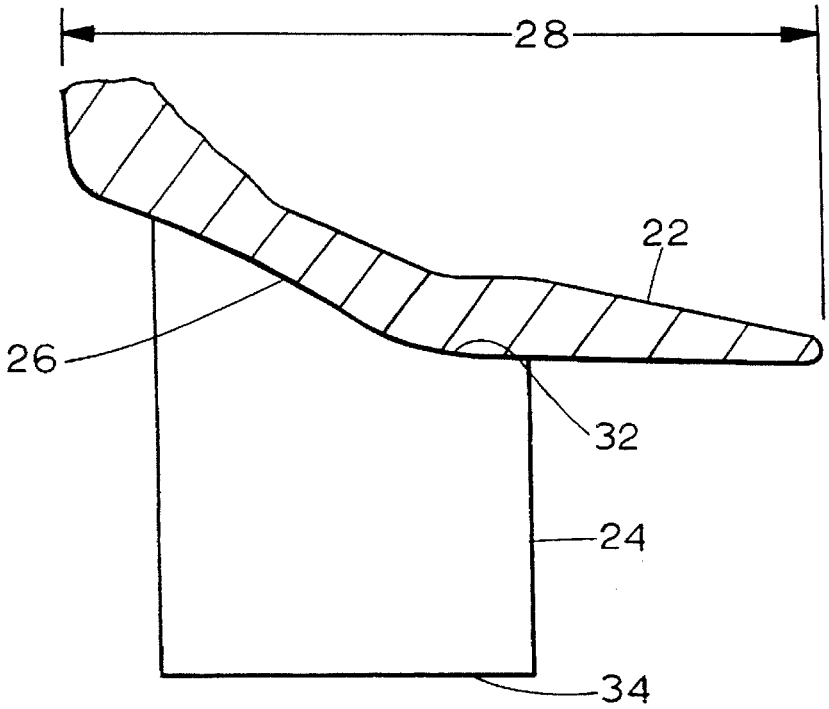
FIG. 4 is an enlarged view of a portion of the nozzle structure shown in FIG. 2.
Figure 5:
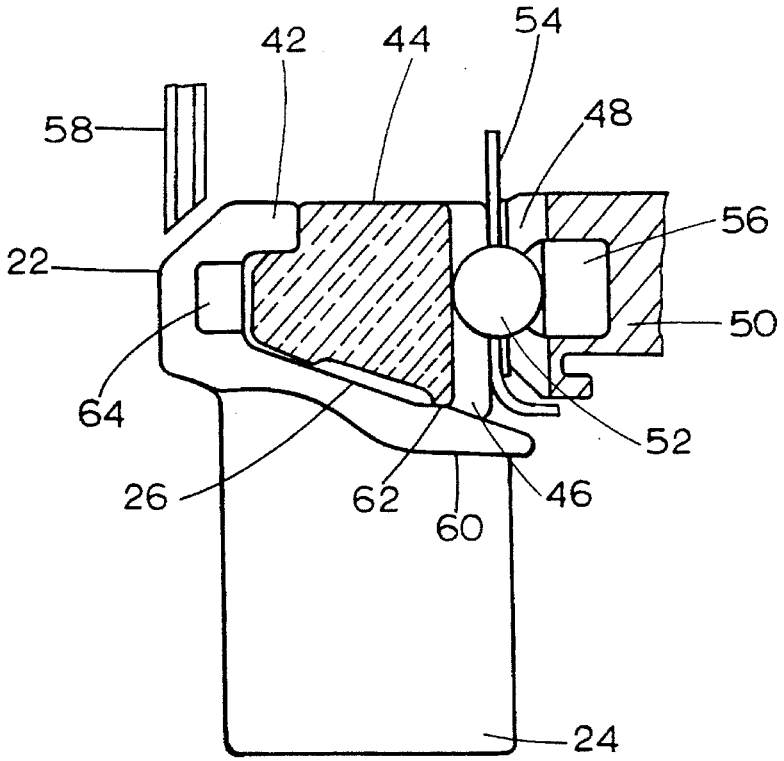
FIG. 5 is an enlarged cross-sectional view of a segment of the nozzle structure and of the nozzle support ring shown in FIG. 2.
Figure 6:
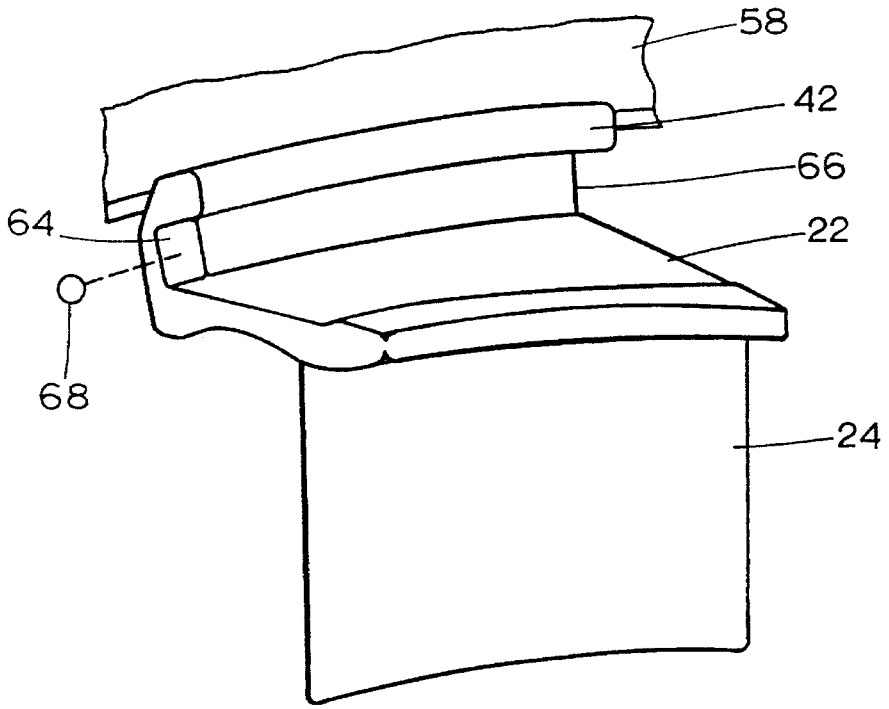
FIG. 6 is a perspective view of a portion of the segment of the nozzle structure shown in FIG. 5.
Figure 7:
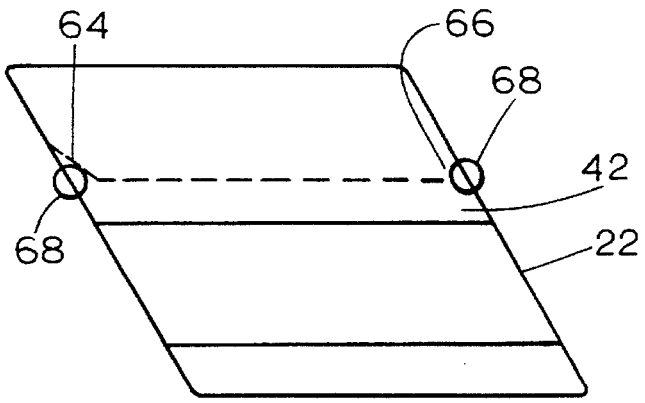
FIG. 7 is a top view of a portion of the segment of the nozzle structure shown in FIG. 6; and, FIG. 8 is an end view of the nozzle support ring.

Accordingly, the nozzle structure 10 includes an outer shroud having a plurality of outer shroud segments 22, and a plurality of airfoil vanes 24. As shown in FIGS. 2, 3, and 4, each of the outer shroud segments 22 has an inwardly facing surface 26 (FIG. 2) which generally converges radially inwardly in the direction of the gas flow path A, and which extends a predetermined axial distance 28 (FIG. 4) and a predetermined circumferential distance 30 (FIG. 3). Each airfoil vane 24 has a first end 32 which is joined to the inwardly facing surface 26 of a corresponding outer shroud segment 22, each airfoil vane 24 extends radially inwardly by a predetermined radial distance, and each airfoil vane 24 terminates at a second, unsupported, and free end 34.

As shown in FIG. 2, the inner shroud 12, which may either be of unitary construction or comprised of a plurality of inner shroud segments, has an outwardly facing surface 36 which generally faces, and cooperates with, the inwardly facing surface 26 of the outer shroud segments 22 to form an annular fluid flow channel with the airfoil vanes 24 being disposed therein at equally spaced arcuate intervals. The outwardly facing surface 36 of the inner shroud 12 is radially separated from the second ends 34 of the airfoil vanes 24 by a predetermined separation distance 38.

The nozzle structure 10 includes a fastening arrangement 40 which supports the plurality of outer shroud segments 22 and corresponding airfoil vanes 24. The fastening arrangement 40 may include a plurality of hooks, such as a hook 42 shown in FIGS. 5, 6, and 7. Each hook 42 may be formed integrally with a corresponding one of the outer shroud segments 22, and each hook 42 cooperates with a nozzle support ring 44. The nozzle support ring 44 is preferably annular.

The outer shroud segments 22, and the airfoil vanes 24, the hooks 42, and the nozzle support ring 44 may be ceramic.

Figure 8:
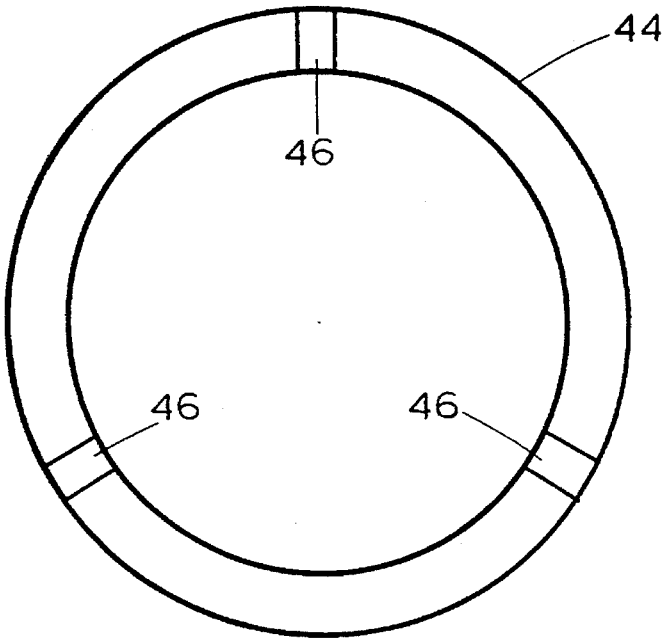

As shown in FIG. 8, the nozzle support ring 44 may be provided with a plurality of arcuate recesses 46 which cooperate with a corresponding plurality of arcuate recesses 48 in a nozzle housing 50. The nozzle housing 50 is typically found in a gas turbine engine such as the gas turbine engine 2. The cooperating arcuate recesses 46 and 48 form a plurality of cylindrical raceways within each of which a corresponding ball 52 is retained by a sheet metal plate 54 and a piston 56. The balls 52 may be ceramic. The sheet metal plate 54 may be annular and may be arranged to conduct air over the ball 52 in order to cool the ball 52. The sheet metal plate 54 has a ball receiving hole therein which corresponds to the ball 52 of each cylindrical raceway and which is dimensioned to confine the ball 52 within the raceway formed by the cooperating arcuate recesses 46 and 48. The piston 56 may be ceramic and is arranged to urge the ball into a corresponding ball receiving hole in the sheet metal plate 54. Therefore, the sheet metal plate 54 and the piston 56 form a ball retainer for the ball 52. The nozzle structure 10 is impeded from axial movement within the gas turbine engine 2 by the nozzle housing 50, the sheet metal plate 54, and a sheet metal plate 58. The sheet metal plate 58 may be annular.

Each of the outer shroud segments 22 has at least first and second surfaces 60 and 62. The second surface 62 is angled with respect to its corresponding hook 42 so that a slipping angle is formed between the second surface 62 and its corresponding hook 42, and so that the nozzle support ring 44 is engaged between the hook 42 and the second surface 62 of the corresponding outer shroud segment 22. If desired, the outer shroud segments 22 may be arranged so that their corresponding hooks 42 apply a clamping pressure on the nozzle support ring 44. Accordingly, each of the outer shroud segments 22 and its corresponding airfoil vane 24 are supported by the corresponding hooks 42 on the nozzle support ring 44.

The slipping angle between the second surface 62 and the hook 42 should be chosen so that thermal jacking between the hook 42 and the nozzle support ring 44, which could damage or break the hook 42, is prevented. This thermal jacking results from unequal thermal expansion and shrinkage between the elements of the gas turbine engine 2. By choosing the slipping angle correctly, the outer shroud segment 22 is permitted a certain degree of slippage with respect to the nozzle support ring 44 in order to prevent the hook 42 from breaking or being damaged due to thermal stress. This slipping angle may be, for example, between 30° and 45°.

Furthermore, an inner surface of the hook 42 on each of the outer shroud segments may be chamfered or angled inwardly at points 64 and 66 in order to cooperate with corresponding recesses on the nozzle support ring 44 to form key slots to receive keys 68, which may be in the form of balls, between the outer shroud segments 22 and the nozzle support ring 44. Accordingly, the outer shroud segments 22 are prevented from circumferential movement around the nozzle support ring 44. The keys 68 may be ceramic.

INDUSTRIAL APPLICABILITY

In operation, air is drawn through the inlet opening 6 and is compressed by the compressor section of the gas turbine engine 2. The compressed air is mixed with fuel and the resulting fuel/air mixture is burned by the combustor section of the gas turbine engine 2 to produce high temperature gas. The nozzle structure 10, including the airfoil vanes 24, and in cooperation with the inner shroud 12, directs the expanding high temperature gas provided at the annular exit port 20 of the combustor 14 to the blades, such as a blade 70, attached to a turbine wheel 72 of the turbine section of the gas turbine engine 2.

Each of the airfoil vanes 24 is supported by a hook 42 of a corresponding outer shroud segment 22 on the nozzle support ring 44. The nozzle support ring 44 radially confines the outer shroud segments 22 and corresponding airfoil vanes 24, and the combination of the nozzle housing 50, the sheet metal plate 54, and the sheet metal plate 58 axially confines the outer shroud segments 22 and corresponding airfoil vanes 24.

Due primarily to differences in material and mass, the nozzle support ring 44, which may be ceramic, and the nozzle housing 50, which may be high temperature metal, expand and shrink at different rates in response to temperature changes within the gas turbine engine 2. Each ball 52 between the nozzle support ring 44 and the nozzle housing 50 allows relative radial movement between the nozzle support ring 44 and the nozzle housing 50 as the nozzle support ring 44 and the nozzle housing 50 expand and shrink radially at different rates. Furthermore, as the nozzle support ring 44 and the nozzle housing 50 expand and shrink at different rates, each ball 52 rolls over the surface of the arcuate recesses 46 of the nozzle support ring 44 thereby preventing scuffing and possible fracture of the nozzle support ring 44 due to surface imperfections in the nozzle support ring 44. Moreover, differences in expansion and shrink rates between the outer shroud segments 22, the nozzle support ring 44, and the nozzle housing 50 are accommodated by the slipping angle between the second surface 62 and the hooks 42.

The predetermined separation distance 38 between the airfoil vanes 24 and the inner shroud 12 results in decoupling of the airfoil vanes 24 from the inner shroud 12. This decoupling substantially reduces stress on the airfoil vanes 24. Accordingly, each airfoil vane 24 is free to expand to a far greater extent that would be possible if it was attached at both of its ends between the inner shroud 12 and the outer shroud segments 22.

Certain modifications and alternatives to the present invention have been described above. Other modifications and alternatives invention will be apparent to those skilled in the art. For example, while the first end 32 of the airfoil vane 24 has been illustrated as being connected to its corresponding outer shroud segment 22 so that the second end 34 of the airfoil vane 24 is a free end, the airfoil vane 24 could instead be connected at its second end 34 to the inner shroud 12 so that the first end 32 of the airfoil vane 24 is a free end. In this arrangement, the inner shroud 12, with its attached airfoil vanes 24, would be supported on a nozzle support ring and the airfoil vanes 24 would extend radially outwardly from the inner shroud 12. All such modifications and alternatives are within the scope of the present invention.

We claim:

1. An annular nozzle arrangement for a gas turbine engine comprising:

a ceramic annular nozzle support ring;

a ceramic annular shroud having a ceramic hook engaging the ceramic annular nozzle support ring so that the ceramic annular shroud is supported by the ceramic annular nozzle support ring and so that slipping i$ permitted between the ceramic annual shroud and the ceramic annular nozzle support ring in response to thermal changes; and, a ceramic airfoil vane connected to the ceramic annular shroud.

2. The annular nozzle arrangement of claim 1 wherein the ceramic annular shroud has a nozzle support ring facing surface which forms a slipping angle with respect to the ceramic hook so as to permit the slipping, wherein the nozzle support ring facing surface engages the ceramic nozzle support ring, and wherein the slipping angle is arranged to prevent damage to the ceramic hook due to thermal jacking.

3. The annular nozzle arrangement of claim 1 further comprising:

a nozzle housing, the nozzle housing and the ceramic annular nozzle support ring being arranged to form a raceway;

a ball; and, a ball retainer arranged to retain the ball in the raceway to permit relative radial movement between the annular ceramic nozzle support ring and the nozzle housing.

4. The annular nozzle arrangement of claim 3 wherein the ceramic annular shroud has a nozzle support ring facing surface which forms a slipping angle with respect to the ceramic hook so as to permit the slipping, wherein the nozzle support ring facing surface engages the ceramic nozzle support ring, and wherein the slipping angle is arranged to prevent damage to the ceramic hook due to thermal jacking.

5. The annular nozzle arrangement of claim 4 wherein the ball is ceramic.

6. The annular nozzle arrangement of claim 3 wherein the ball retainer is a piston and a plate, the plate having a ball receiving hole therein, and the piston being arranged to urge the ball into the ball receiving hole.

7. The annular nozzle arrangement of claim 6 wherein the piston and the ball are ceramic.

8. The annular nozzle arrangement of claim 6 further comprising a key between the ceramic annular shroud and the ceramic annular nozzle support ring, the key being arranged to inhibit relative rotation between the ceramic annular shroud and the ceramic annular nozzle support ring.

9. The annular nozzle arrangement of claim 8 wherein the piston, the key, and the ball are ceramic.

10. The annular nozzle arrangement of claim 1 further comprising a key between the ceramic annular shroud and the ceramic annular nozzle support ring, the key being arranged to inhibit relative rotation between the ceramic annular shroud and the ceramic annular nozzle support ring.

11. The annular nozzle arrangement of claim 10 wherein the ceramic annular shroud has a nozzle support ring facing surface which forms a slipping angle with respect to the ceramic hook so as to permit the slipping, wherein the nozzle support ring facing surface engages the ceramic nozzle support ring, and wherein the slipping angle is arranged to prevent damage to the ceramic hook due to thermal jacking.

12. The annular nozzle arrangement of claim 11 wherein the key is ceramic.

13. A nozzle arrangement for a gas turbine engine comprising:

flow directing means for directing gas flow from a combustor section of the gas turbine engine to a turbine wheel of the gas turbine engine;

supporting means for supporting the flow directing means, the supporting means being ceramic; and, the flow directing means including a ceramic hook engaging the supporting means so that the flow directing means is supported by the supporting means and so that slipping is permitted between the hook and the supporting means due to thermal changes.

14. The nozzle arrangement of claim 13 wherein the supporting means comprises a first element, wherein the nozzle arrangement further comprises a raceway, a ball, a ball retainer, and a second element, and wherein the ball retainer is arranged to retain the ball in the raceway to permit relative radial movement between the first and second elements.

15. The nozzle arrangement of claim 14 wherein the ball retainer comprises a piston and a plate, the plate having a ball receiving hole therein, and the piston being arranged to urge the ball into the ball receiving hole.

16. The nozzle arrangement of claim 15 further comprising a key being arranged to inhibit circumferential movement of the flow directing means.

17. The nozzle arrangement of claim 13 further comprising a key being arranged to inhibit circumferential movement of the flow directing means.

18. A nozzle arrangement for a gas turbine engine comprising:

a ceramic nozzle support ring;

a plurality of ceramic shroud segments distributed around the ceramic nozzle support ring, each of the ceramic shroud segments having a ceramic hook engaging the ceramic nozzle support ring so that each of the ceramic shroud segments is supported by the ceramic nozzle support ring and so that slipping is permitted between the ceramic hooks and the ceramic nozzle support ring due to thermal changes; and, a plurality of ceramic airfoil vanes, each of the ceramic airfoil vanes having first and second ends, wherein the first end of each ceramic airfoil vane is connected to a corresponding ceramic shroud segment so that the ceramic airfoil vanes are distributed around the ceramic nozzle support ring so as to direct gas flow from a combustor section of a gas turbine engine to a turbine wheel of the gas turbine engine, and wherein the second end of each ceramic airfoil vane is a free end.

19. The nozzle arrangement of claim 18 wherein each of the ceramic shroud segments has a nozzle support ring facing surface which forms a slipping angle with respect to the ceramic hook on a corresponding ceramic shroud segment, wherein the nozzle support ring facing surface of each ceramic shroud segment engages the ceramic nozzle support ring, and wherein the slipping angle of each ceramic shroud segment is arranged to prevent damage to a corresponding ceramic hook due to thermal jacking.

20. The nozzle arrangement of claim 18 further comprising a nozzle housing and means for permitting relative radial movement between the ceramic nozzle support ring and the nozzle housing.

21. The nozzle arrangement of claim 20 wherein the nozzle housing and the ceramic nozzle support ring have a plurality of raceways, wherein the means for permitting relative movement comprises a plurality of ceramic balls and ball retainers, and wherein the ball retainers are arranged to retain at least one ceramic ball in each of the raceways to permit relative radial movement between the ceramic nozzle support ring and the nozzle housing.

22. The nozzle arrangement of claim 21 wherein each of the ceramic shroud segments has a nozzle support ring facing surface which forms a slipping angle with respect to the ceramic hook on a corresponding ceramic shroud segment, wherein the nozzle support ring facing surface of each ceramic shroud segment engages the ceramic nozzle support ring, and wherein the slipping angle of each ceramic shroud segment is arranged to prevent damage to a corresponding ceramic hook due to thermal jacking.

23. The nozzle arrangement of claim 21 wherein the ball retainers comprise ceramic pistons and a plate, the plate having ball receiving holes therein, and the ceramic pistons being arranged to urge the ceramic balls into the ball receiving holes.

24. The nozzle arrangement of claim 23 wherein each of the ceramic shroud segments has a nozzle support ring facing surface which forms a slipping angle with respect to the ceramic hook on a corresponding ceramic shroud segment, wherein the nozzle support ring facing surface of each ceramic shroud segment engages the ceramic nozzle support ring, and wherein the slipping angle of each ceramic shroud segment is arranged to permit the slipping between the ceramic hooks and the ceramic nozzle support ring so as to prevent damage to a corresponding ceramic hook due to thermal jacking.

25. The nozzle arrangement of claim 23 further comprising a plurality of ceramic keys between the ceramic shroud segments and the ceramic nozzle support ring, the ceramic keys being arranged to inhibit relative rotation between the ceramic shroud segments and the ceramic nozzle support ring.

26. The nozzle arrangement of claim 25 wherein each of the ceramic shroud segments has a nozzle support ring facing surface which forms a slipping angle with respect to the ceramic hook on a corresponding ceramic shroud segment, wherein the nozzle support ring facing surface of each ceramic shroud segment engages the ceramic nozzle support ring, and wherein the slipping angle of each ceramic shroud segment is arranged to permit the slipping between the ceramic hooks and the ceramic nozzle support ring so as to prevent damage to a corresponding ceramic hook due to thermal jacking.

27. The nozzle arrangement of claim 18 further comprising a plurality of ceramic keys between the ceramic shroud segments and the ceramic nozzle support ring, the ceramic keys being arranged to inhibit relative rotation between the ceramic shroud segments and the ceramic nozzle support ring.

28. The nozzle arrangement of claim 27 wherein each of the ceramic shroud segments has a nozzle support ring facing surface which forms a slipping angle with respect to the ceramic hook on a corresponding ceramic shroud segment, wherein the nozzle support ring facing surface of each ceramic shroud segment engages the ceramic nozzle support ring, and wherein the slipping angle of each ceramic shroud segment is arranged to permit the slipping between the ceramic hooks and the ceramic nozzle support ring so as to prevent damage to a corresponding ceramic hook due to thermal jacking.

* * * * *